US005531084A

United States Patent [19]

Laabs et al.

[11] Patent Number: 5,531,084

[45] Date of Patent: * Jul. 2, 1996

[54] KEY FOR ROTARY PLUG AND CYLINDER LOCK, AND METHOD OF FORMING THE KEY

[75] Inventors: Timothy P. Laabs, Palatine; Michael O. Misner, Lake Villa; Richard H. Schulz, Wheeling; Elbert M. Spencer, Wildwood, all of Ill.

[73] Assignee: The Eastern Company, Wheeling, Ill.

[ * ] Notice: The term of this patent shall not extend beyond the expiration date of Pat. No. 5,485,735.

[21] Appl. No.: 397,421

[22] Filed: Mar. 1, 1995

Related U.S. Application Data

[63] Continuation-in-part of Ser. No. 163,149, Dec. 6, 1993, Pat. No. 5,485,735.

[51] Int. Cl.[6] ..... E05B 19/06

[52] U.S. Cl. ..... 70/409; 70/358; 70/406

[58] Field of Search ..... 70/358, 493, 494, 70/409, 405, 406, DIG. 37, 337, 401, 419; 76/110

[56] References Cited

U.S. PATENT DOCUMENTS

| | | | |
|---|---|---|---|
| 913,942 | 3/1909 | Bodge | 70/358 |
| 1,286,456 | 12/1918 | Vogelsang | 70/373 |
| 2,038,677 | 4/1936 | Recht et al. | 70/358 |
| 2,104,397 | 1/1938 | Hurd | 70/493 |
| 2,166,690 | 7/1939 | Neckerman | 70/358 |
| 2,733,590 | 2/1956 | Crumb | 70/367 |
| 3,303,677 | 2/1967 | Bauer | 70/358 |
| 3,349,587 | 10/1967 | Keller | 70/358 |
| 3,393,542 | 7/1968 | Crepinsek | 70/358 |
| 3,412,588 | 11/1968 | Schwegler | 70/358 |
| 3,413,831 | 12/1968 | Crepinsek | 70/358 |
| 3,512,382 | 5/1970 | Check et al. | 70/276 |
| 3,656,328 | 4/1972 | Hughes | 70/276 |
| 3,938,358 | 2/1976 | Doyle et al. | 70/358 |
| 3,974,670 | 8/1976 | Wolter | 70/364 |
| 4,098,104 | 7/1978 | Wolter | 70/406 |
| 4,100,778 | 7/1978 | Gretler | 70/406 |
| 4,116,025 | 9/1978 | Wolter | 70/358 |
| 4,122,694 | 10/1978 | Gretler | 70/406 |
| 4,137,739 | 2/1979 | Keller | 70/358 |
| 4,343,166 | 8/1982 | Hofmann | 70/358 |
| 4,667,495 | 5/1987 | Girard et al. | 70/398 |
| 4,770,014 | 9/1988 | Knauer | 70/358 |
| 5,131,249 | 7/1992 | Baden et al. | 70/398 |

FOREIGN PATENT DOCUMENTS

| | | | |
|---|---|---|---|
| 0305336 | 3/1989 | European Pat. Off. | 70/358 |

*Primary Examiner*—Lloyd A. Gall
*Attorney, Agent, or Firm*—David A. Burge

[57] ABSTRACT

A difficult-to-duplicate key for operating a rotatable plug and cylinder lock has an imaginary center axis that extends along the length of the key at a location situated between opposed, relatively narrow edge surfaces, and centered between opposed, relatively wide side surfaces. The edge and side surfaces cooperate to define a key of generally rectangular cross section. First, second and third rows of concave recesses are formed in and extend lengthwise along the side and edge surfaces of the key for receiving rounded inner end regions of pin tumblers of the plug and cylinder lock when the key is inserted to an operating position in a keyway of the lock for positioning the tumblers to permit the plug to be rotated relative to the cylinder. The recesses of the first, second and third rows extend along first, second and third sets of recess axes that extend in first, second and third planes, respectively, that radiate from the imaginary center axis. Non-standard angular relationships of the first, second and third planes are utilized to orient the first, second and third sets of axes in a non-standard, non-symmetrical and non-aligned manner that causes the recesses of at least one (preferably two) of the first, second and third rows to be of a non-circular shape that is difficult to "read" to determine the key's recess axis orientation. The use of difficult to "read" recess shapes together with the use of non-standard recess axis orientations renders key duplication difficult.

36 Claims, 4 Drawing Sheets

KEY FOR ROTARY PLUG AND CYLINDER LOCK, AND METHOD OF FORMING THE KEY

CROSS-REFERENCE TO RELATED APPLICATION

The present application is a continuation-in-part of application Ser. No. 08/163,149 filed Dec. 6, 1993, U.S. Pat. No. 5,485,735 entitled KEY OPERATED ROTARY PLUG AND CYLINDER LOCK, filed by Timothy P. Laabs, Michael O. Misner, Richard H. Schulz and Elbert M. Spencer (referred to hereinafter as the "Parent Case"), the disclosure of which is incorporated herein by reference.

BACKGROUND OF THE INVENTION

1. Field of the Invention

The present invention relates to a difficult to "read" and difficult to duplicate key for operating a uniquely constructed rotatable plug and cylinder lock of the type that utilizes three sets of tumbler pins arranged in three rows extending in three planes that radiate from a common axis that extends centrally through a plug-defined keyway for engaging one row of recesses formed in a narrow edge surface, and two rows of recesses formed in opposed flat side surfaces of a substantially flat key. More particularly, the present invention relates to a key for operating a plug and cylinder lock of the type described, wherein the key defines three rows of generally concave recesses, with the recesses of the first row being formed in an edge surface of the key and being generally circular in shape, with the recesses of the second and third rows being formed in opposite side surfaces of the key, and with the recesses of at least one (preferably both) of the second and third rows being non-circular or "oblong" in shape so as to be difficult to "read" to determine the non-standard axis inclination angles that have been used in forming the non-circular recesses, whereby determining how to correctly duplicate a key that will operate the lock is rendered difficult.

2. Prior Art

Rotatable plug and cylinder locks are known that employ three rows of tumbler pins arrayed about a central axis of a plug-defined keyway for engaging recesses that are formed in opposite side and edge surfaces of a flat key that can be reversibly inserted into the keyway. One of the rows of tumbler pins typically engages recesses formed in an edge surface of an inserted key, while each of the other rows engages recesses formed in a separate one of the opposed flat sides of the inserted key.

A traditional approach that has been taken in arranging three rows of tumbler pins to engage recesses formed in a substantially flat key has called for a first row of tumbler pins to extend in a first plane that is disposed between and parallels the opposed flat sides of an inserted key (so that the first set of tumbler pins engages recesses formed in a narrow edge surface of the inserted key) with second and third sets of tumbler pins extending in second and third planes, respectively, that extend from the central axis on opposite sides of the first plane, at equal angles of inclination relative to the first plane (whereby a "symmetrical" arrangement of tumbler pins is defined in that the second and third sets of tumbler pins extend in planes that are inclined at equal angles relative to the first plane and therefore can be said to be arranged symmetrically about the first plane).

Two "symmetrical" arrangements of three rows of tumbler pins have gained wide acceptance for use with flat keys. One widely accepted arrangement calls for second and third sets of tumbler pins to be inclined at right angles relative to a first edge-engaging set of tumbler pins, with the first, second and third sets extending in first, second and third planes, respectively, that intersect at right angles along a center axis that extends centrally through a plug-defined keyway. With this arrangement, the second and third sets of tumbler pins are "aligned" in the sense that they extend in opposite directions within a common plane. Recesses that are formed in opposite sides of a key to receive inner ends of the tumblers are not "oblong" (as is the case when the recesses are drilled at angles of inclination other than ninety degrees), but rather are distinctively circular—which enables one who is skilled in the art to ascertain the angular relationship of tumblers in a lock by gaining only a quick glance at a key that operates the lock. This "right angle" arrangement of second and third sets of tumbler pins relative to a first set has come to be referred to as a "90/90" arrangement, with each of the numerals "90" referring to angles of inclination of second and third rows of tumbler pins relative to a first row of tumbler pins that engages a flat edge surface of an inserted key.

A more secure, somewhat more difficult to defeat arrangement of three sets of tumbler pins that has come to be widely used with a flat key calls for second and third rows of tumbler pins to be equally inclined at angles of one hundred five degrees relative to a first row of edge-engaging tumbler pins. With this arrangement, recesses that are formed in opposite flat sides of a key for receiving inner ends of the second and third rows of tumblers are of "oblong" shape inasmuch as they are drilled at one hundred five degree angles relative to the flat side surfaces of the key. A problem with this symmetrical "105/105" arrangement of tumblers is that it has come to be sufficiently well known that it ordinarily is "assumed to exist" by those who are skilled in the art when they see the characteristically "oblong" shaped recesses that are formed in opposite flat sides of a key that is used to operate a lock of this type. As those who are skilled in the art of picking locks have come to be increasingly familiar with techniques that can be used to defeat locks that employ the relatively standard 105/105 symmetrical arrangement of tumbler pins, locks that embody this tumbler pin arrangement are progressively coming to be viewed as providing less than a desired degree of security.

The 90/90 and 105/105 symmetrical arrangements of tumbler pins have come to be so widely accepted for use with flat keys that key cutting machines now are available that are designed to form recesses in opposite sides of keys that either are inclined at ninety degrees or at one hundred five degrees. Thus, when it comes to producing keys that have recesses that will accommodate pins that extend toward flat side surfaces of an inserted key at angles of either ninety or one hundred five degrees, relatively little difficulty is encountered—a factor that also tends to diminish the degree of "security" that is perceived to be associated with locks that employ 90/90 and 105/105 symmetrical tumbler pin arrangements.

3. The Referenced Parent Case

The Parent Case referenced above addresses the foregoing and other drawbacks and shortcomings of the prior art by providing a key operated rotatable plug and cylinder lock of the type that utilizes a non-symmetrical arrangement of three rows of tumbler pins that extend in planes that radiate from a common axis that extends centrally through a plug-defined keyway, with one row of tumblers being positioned to engage recesses formed in a narrow edge surface of an inserted flat key, and with the other two rows of tumblers being positioned to engage recesses formed in opposed side surfaces of an inserted flat key. While one of the three planes extends from the center axis in a direction that parallels the opposed, relatively flat side surfaces of a keyway-inserted key to position a first row of tumblers to engage recesses that are formed in a narrow edge surface of an inserted flat key (just as has come to be widely accepted), the other two planes (within which second and third sets of tumblers operate) extend from the center axis in non-aligned directions that provide a "non-standard," "non-symmetrical" array of tumbler pin inclinations that renders significantly more difficult the duplication of keys and the picking of locks.

As is disclosed in the Parent Case, one of a set of guidelines that governs the selection of angles of inclination for the second and third planes relative to the first plane calls for each of these inclination angles to be selected from within ranges of about seventy five to about one hundred five degrees, and for each to be chosen from a set of angles that differ from each other by at least about five degrees. This guideline is dictated by a discovery that resides at the heart of the invention of the Parent Case, namely that, within a range of inclination angles extending from about seventy five degrees to about one hundred five degrees, the use of unequal inclinations (of the second and third rows of tumbler pins relative to the first row) that differ by at least about five degrees frustrates picking efforts and significantly complicates key duplication efforts.

While selectable inclination angles (of the second and third rows of tumbler pins relative to the first row) may, if desired, be spaced apart within the range of seventy five to one hundred five degrees by more than five degrees (e.g., by defining ten degree increments that provide selectable inclination angles of 75, 85, 95 and 105 degrees), five degree increments (that, for example, can provide selectable inclination angles of 75, 80, 85, 90, 95, 100 and 105 degrees, or an alternative set of angles such as 78, 83, 88, 93, 98 and 103 degrees) serve the intended purposes.

Also disclosed in the Parent Case is another guideline that governs the inclinations of the second and third planes relative to the first plane, by calling for the second and third planes to be arranged such that they do not "align" so as to extend within a common plane. Inasmuch as it has been found that locks having three rows of tumblers tend to be more easily picked if two of the rows of tumblers are "aligned" (as by extending in precisely opposite directions within a common plane for engaging opposite flat side surfaces of an inserted key), the invention of the Parent Case calls for "aligned" rows of tumbler pins to be avoided.

Still another guideline disclosed in the Parent Case for governing the inclinations of the second and third planes relative to the first plane calls for the second and third planes to be arranged so that they do not extend at equal angles of inclination relative to the first plane. Inasmuch as locks having second and third rows of tumbler pins that are inclined at equal angles relative to a first row of tumbler pins tend to be easier to pick (and their keys tend to be easier to form) than is the case with locks that have "non-symmetrical" arrangements of tumblers, the invention of the Parent Case calls for "symmetrical" tumbler arrangements to be avoided.

Still another guideline disclosed in the Parent Case that governs the selection of inclination angles for the second and third planes calls for the commonly utilized inclination angles of ninety and one hundred five degrees to be avoided, at least in the selection of one, preferably both, of these inclination angles. By inclining at least one (preferably both) of the second and third planes at non-standard, non-symmetrical inclination angles of other than ninety and one hundred five degrees, the resulting locks are rendered more difficult to pick, and keys for such locks are rendered more difficult to produce and duplicate.

SUMMARY OF THE PRESENT INVENTION

In addition to disclosing a plug and cylinder lock having a keyway of generally rectangular cross section into which inner end regions of three rows of tumblers project, the referenced Parent Case also discloses a difficult-to-duplicate key of generally rectangular cross section for being inserted into the keyway to operate the lock. The key, and the manner in which it is formed to provide three rows of tumbler-receiving recesses, are the subject of the present case.

As is disclosed in the Parent Case, the key defines three rows of generally concave recesses (six rows if the key is configured to function regardless of whether it is right-side-up or upside down) for receiving and positioning first, second and third rows of tumblers of a plug and cylinder lock for permitting the lock to be "operated" as by rotating the plug relative to the cylinder. When the key is inserted into the keyway of the lock to a position wherein inner end regions of the tumblers are received by the key-defined recesses and are thereby positioned to permit rotation of the plug relative to the cylinder, the key is said to be in its "operating position."

As is further disclosed in the Parent Case, when the key is inserted in the keyway of the lock to its operating position, the imaginary center axis of the lock (i.e., the axis about which the plug is rotatable relative to the cylinder when the lock is being "operated" by the key) also defines an imaginary center axis of the key. The imaginary center axis of the key is spaced between the opposed, relatively narrow edge surfaces of the key, and is substantially equally spaced between the relatively wider opposed side surfaces of the key.

As is further disclosed in the Parent Case, three sets of tumbler-carrying passages are formed in the plug and cylinder of the lock. The passages of a first set extend along first axes that extend parallel to each other and lie within a first plane that intersects the imaginary center axis of the lock. The passages of the second set extend along second axes that extend parallel to each other and lie within a second plane that intersects the imaginary center axis of the lock. The passages of the third set extend along third axes that extend parallel to each other and lie within a third plane that intersects the imaginary center axis of the lock. All of the first, second and third axes perpendicularly intersect the center axis.

As is further disclosed in the Parent Case, the three sets of tumbler-receiving recesses that are formed in the key are oriented in exactly the same way as are the three sets of tumbler-carrying passages that are formed in the plug and cylinder of the lock. By this arrangement, when the key is inserted into the keyway to its operating position, what the recesses effectively do is to align with and close the otherwise open inner ends of the passages—so that tumblers that are carried together with springs within the passages of the lock are positioned, by virtue of their engagement with the recesses of the key, to permit the lock to be operated.

In the Parent Case, and in the present case, what is meant by stating that a recess "extends along" or "is oriented to extend along" a particular axis is that the three-dimensional surface that defines the concavity of the recess is substantially symmetrical about the particular axis—and therefore is of the character of the surface that would be generated by rotating an appropriately configured parabola while its center axis extends along the particular axis, or that would be formed by drilling or milling a recess by rotating a drill bit or a rounded-end end mill about the particular axis.

While the relative orientations of the passages and their associated key-carried recesses are unique to the lock and key that are disclosed in the referenced Parent Case, the manner in which the passages are formed in the plug and cylinder of the lock, and the manner in which the recesses are formed in the key represent nothing new. Conventional drilling and/or milling techniques that employ conventional drills and/or end mills that are rotated about the aligned axes of the passages and the recesses are employed. Thus, the pith of the lock and key inventions disclosed in the Parent Case has to do with passage, tumbler and recess orientations—and with the character of the "difficult to read" non-circular or "oblong" recesses that are thereby caused to be formed in at least one of the opposed sides of the key.

As is further disclosed in the Parent Case, the recesses of the first row are formed in an edge surface of the key. Since the recesses of the first row extend along first axes that substantially perpendicularly intersect the key edge surface in which these recesses are formed, the recesses of the first set are generally circular in shape. Since the recesses of at least a selected one of the second and third rows extend along at least a selected one of the sets of second and third axes in a direction that is not perpendicular to the associated side surface of the key, the recesses of at least a selected one of the second and third rows will not be of circular shape; rather, they will be "oblong" in shape.

Due to the small size and shallow depth of these non-circular or "oblong" recesses, and due to the fact that non-circular of "oblong" recesses formed at different angles of orientation (i.e., recesses that extend along differently inclined axes) have very similar appearances, the non-circular or "oblong" recesses are difficult to "read" (either visually or by use of anything other than highly accurate instruments) to determine their axes of orientation. Because the plugs, cylinders and tumblers of so-called "high security" locks are manufactured with very close tolerances, keys that are provided to operate these locks also need to be manufactured with very close tolerances—which includes the formation of their recesses to extend along proper axes of orientation. Thus, keys that define non-circular recesses that extend along non-standard axes of inclination (i.e., along axes other than those that are associated with the relatively standard "90/90" and "105/105" symmetrical orientation arrangements that are discussed above) tend to be difficult to "read" and therefore tend to be difficult to duplicate with sufficient accuracy to perform their intended function.

The present case includes claims for more fully protecting keys of the difficult-to-duplicate type that are disclosed in the Parent Case, and to the manner in which these keys are fabricated. The use, in combination, of rows of key-defined recesses that are of non-circular or "oblong" nature, in combination with the use of a set of non-standardly-oriented recess axes provides a key that is quite difficult to "read" and to duplicate, and that merits protection separate and apart from the plug and cylinder lock of the referenced Parent Case.

BRIEF DESCRIPTION OF THE DRAWINGS

These and other features, and a fuller understanding of the present invention may be had by referring to the following description and claims, taken in conjunction with the accompanying drawings, wherein:

DESCRIPTION OF THE PREFERRED EMBODIMENT

Because keys that are the subject of the present case are those that operate locks of the type that form the subject of the referenced Parent Case, the description that follows tracks the description that is presented in the Parent Case—and goes into detail regarding the character of such plug and cylinder locks as are designed to be operated by keys that are the subject of the present case.

Figure 1:
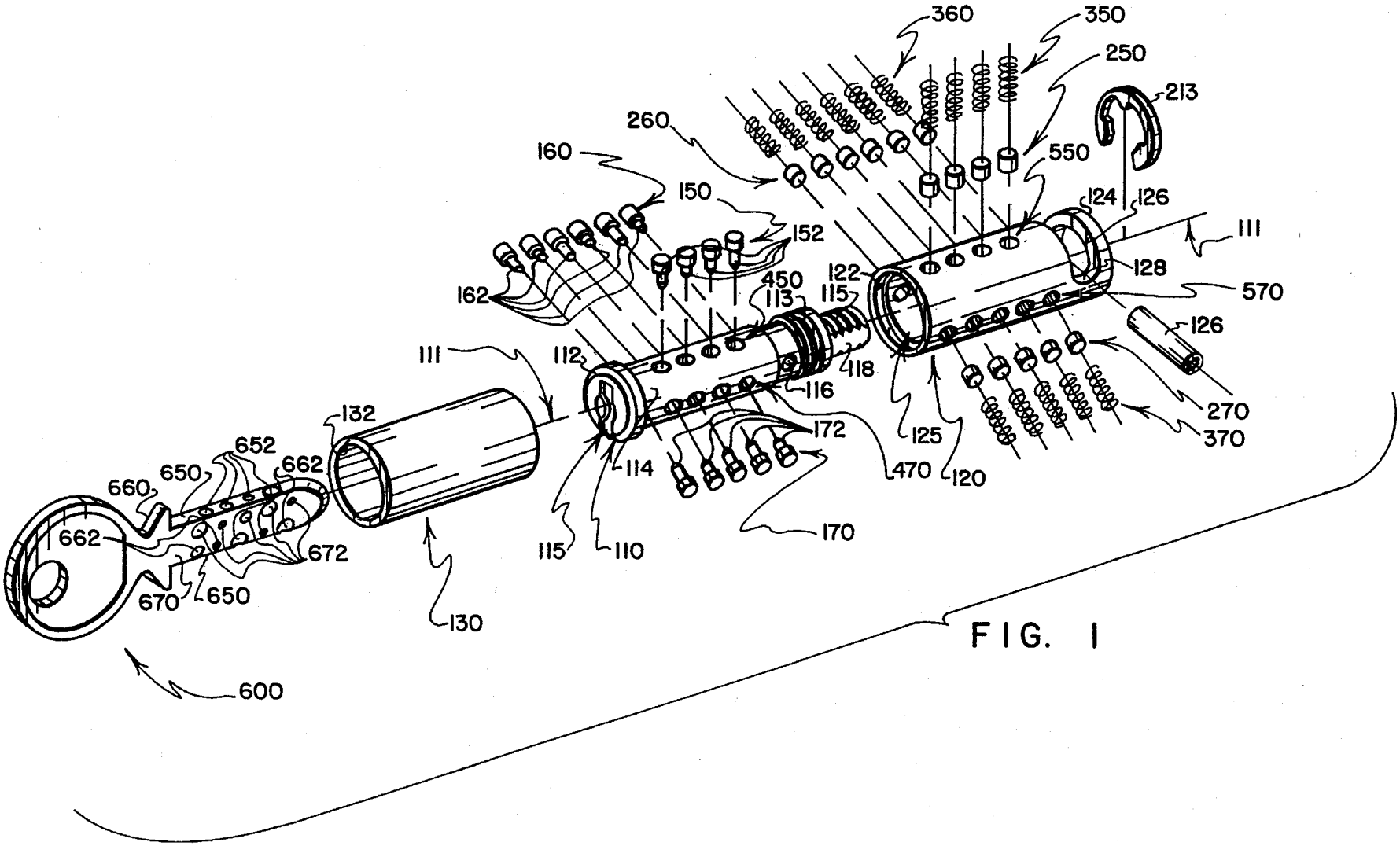
FIG. 1 is an exploded perspective view showing components of a key operated rotary plug and cylinder lock unit that embodies features of the invention of the Parent Case, and showing a recess-defining key that embodies the best mode known for carrying out the preferred practice of the present invention.
Figure 2:
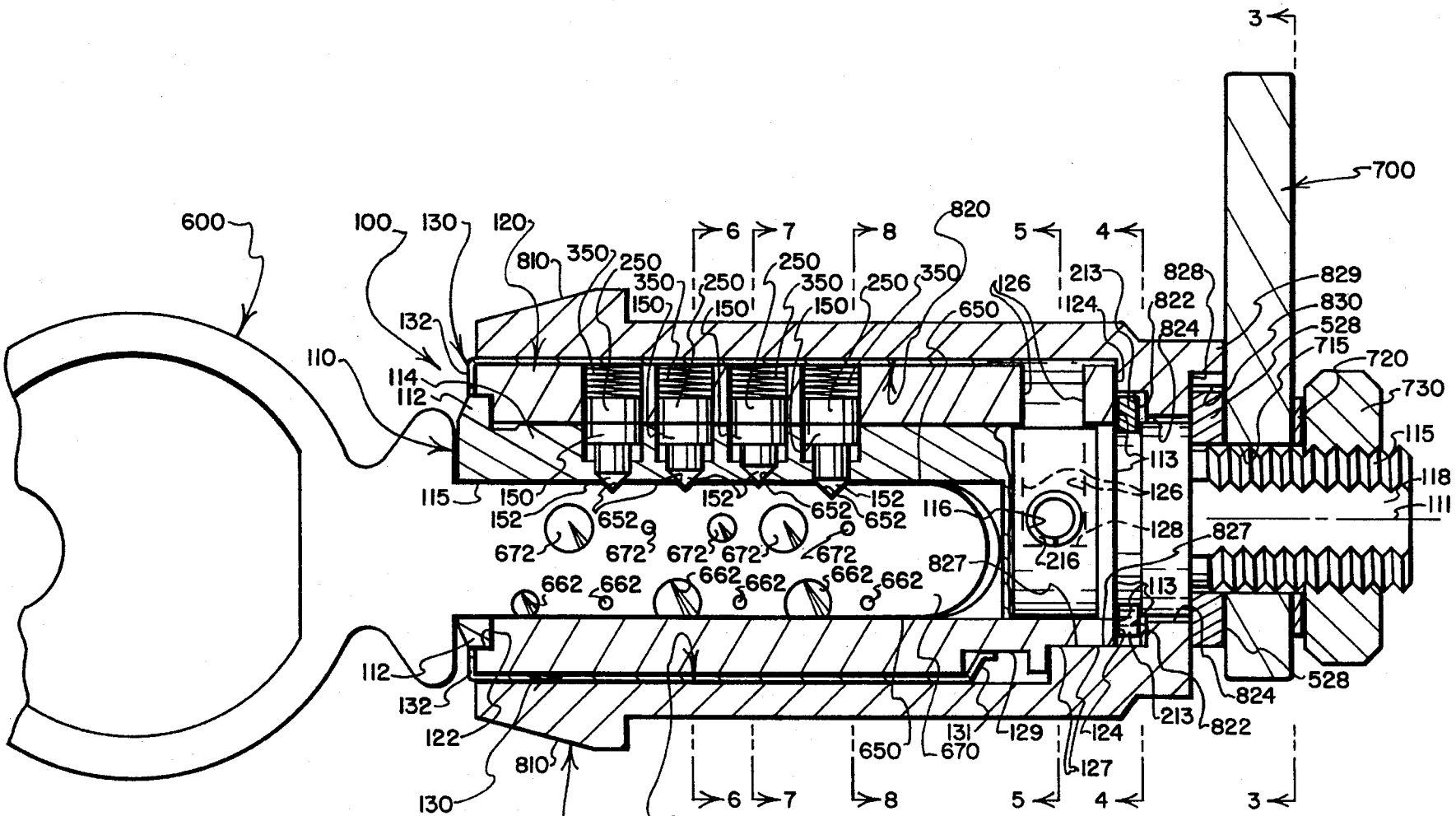
FIG. 2 is a cross-sectional view, on an enlarged scale, as seen from a vertical plane that extends substantially centrally through assembled components of the lock unit of FIG. 1, with the view also showing portions of other components that typically are used with the lock unit of FIG. 1 including a housing in which the assembled components of the lock unit are mounted, a cam that is operated by the lock, and a suitably configured key for operating the lock.

Referring to FIG. 1, a key operated rotary plug and cylinder lock embodying the preferred practice of the invention of the Parent Case is indicated generally by the numeral 100. The lock 100 includes a generally cylindrical plug 110 that defines a keyway 115 of generally rectangular cross section, and a generally cylindrical cylinder 120 that has a generally cylindrical plug-receiving passage 125 formed therethrough for receiving and journaling the plug 110 for smooth rotation therein, and a generally cylindrical thin metal retaining sleeve 130 for snugly surrounding the perimeter of tumbler-receiving portions of the cylinder 120. When assembled, as depicted in FIG. 2, the plug 110, the cylinder 120 and the sleeve 130 extend coaxially about a center axis 111 that extends centrally through the keyway 115.

Referring to FIGS. 1, 2, 9 and 10, three sets of tumbler bottom pins 150, 160, 170, three sets of tumbler driver pins 250, 260, 270, and three sets of springs 350, 360, 370 are provided for insertion into three sets of aligned holes 450, 550 (see FIG. 2), 460, 560 (see FIG. 9) and 470, 570 (see FIG. 10) that are formed in the plug and cylinder 110, 120, respectively. As is depicted variously in FIGS. 2, 9 and 10, inner end regions 152, 162, 172 of the bottom pins 150, 160, 170 are rounded and are extensible 1) into concave recesses 652 formed in an edge surface 650 of a "suitably configured" key 600 (see FIG. 2), 2) into concave recesses 662 formed in a flat side surface 660 of the key 600 (see FIG. 9), and 3) into concave recesses 672 formed in an opposed flat side surface 670 of the key 600 (see FIG. 10), respectively.

A "suitable configuration" of the key 600 that renders the key 600 capable of operating the lock 100 is attained by drilling the recesses 652, 662, 672 1) at proper locations along the key surfaces 650, 660, 670, respectively, 2) at proper angles of inclination relative to the surfaces 650, 660, 670, respectively, and 3) to proper depths—so that when the inner end regions 152, 162, 172 of the bottom tumblers 150, 160, 170 are duly received within the recesses 652, 662, 672, the lines of juncture between the bottom tumblers 150, 160, 170 and the their associated driver tumblers 250, 260, 270 align with the juncture between the plug 110 and the cylinder 120. This alignment (depicted variously in FIGS. 2 and 6–11) frees the plug 110 to rotate within the confines of the plug-receiving passage 125 relative to the cylinder 120 to selectively position an operating member such as a pawl 700 that is depicted in FIG. 2.

So that those who use the key 600 need not be concerned about inserting the key 600 "right side up" into the keyway 115, the key 600 is configured to be "reversible" in the sense that it is configured to operate the lock 100 regardless of which of its opposed edges 650 faces upwardly during insertion of the key 600 into the keyway 115. Thus, a set of the recesses 652 is provided in each of the narrow top and bottom edge surfaces 650 of the key 600, and both of the sets of recesses 662, 672 are provided in each of the flat side surfaces 660, 670 of the key 600.

Figure 3:
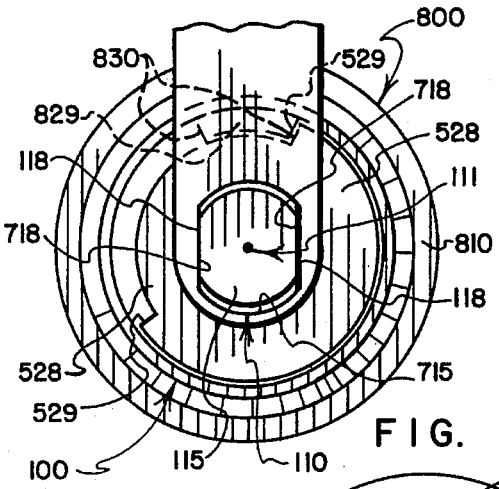
FIGS. 3, 4, 5, 6, 7 and 8 are cross-sectional views of the assembled lock components as seen from planes indicated by lines 3—3, 4—4, 5—5, 6—6, 7—7 and 8—8, respectively, in FIG. 2.

Referring to FIG. 1, the plug 110 has an enlarged diameter front end region 112, and a generally cylindrical body 114 that extends rearwardly from the enlarged diameter front end region 112 toward a diminished diameter rear end region that is threaded, as is indicated by the numeral 115. A pair of opposed flat surfaces 118 (one of which is depicted in FIG. 1, but both of which are depicted in FIG. 3) are formed on opposite sides of the threaded rear end region 115 for drivingly engaging correspondingly configured flat surfaces 718 that are defined on opposite sides of a hole 715 that is formed through the pawl 700 (see FIG. 3). When the pawl 700 is connected to the plug 110 by inserting the threaded end region 115 of the plug 110 through the hole 715 so that the flats 118, 718 drivingly engage, the pawl 700 is connected to the plug 110 for rotation therewith about the center axis 111. Referring to FIG. 2, a lock washer 720 and a nut 730 are installed on the threaded end region 115 for securing the pawl 700 in place on the end region 115 of the plug 110.

Figure 4:
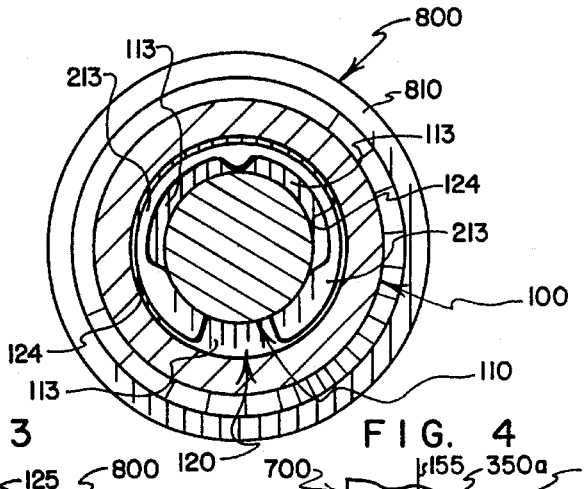

At a location that is spaced slightly forwardly from the rear end region 115 of the plug 110, a groove 113 (see FIGS. 1, 2 and 4) is formed in the plug 110 for receiving a spring steel retaining clip 213. At a still more forward location, a hole 116 (see FIGS. 1, 2 and 5) is formed through the body 114 for receiving a roll pin 216.

Referring to FIG. 2, the plug-receiving passage 125 that is formed in the cylinder 120 has an enlarged diameter front end region 122 that is configured to receive and surround the enlarged diameter front end region 112 of the plug 110. Extending rearwardly from the enlarged diameter front end region 122 to a rear face 124 of the cylinder 120, the passage 125 is of substantially uniform diameter—a diameter that is selected to receive the cylindrical body 114 of the plug 110 in a slip fit that will permit the plug 110 to rotate smoothly within the passage 125 of the cylinder 120.

As is best seen in FIG. 2, the location of the rear face 124 of the cylinder 120 is at the forward edge of the groove 113 that is formed in the plug 110. When the spring steel retaining clip 213 (see FIGS. 2 and 4) is inserted in the groove 113 so as to grip portions of the plug 110 to retain the position of the clip 213 on the plug 110, outer diameter portions of the clip 213 project radially outwardly from the groove 113 for a sufficient distance to overlie portions of the rear face 124 of the cylinder 120—by which arrangement the plug 110 is retained within the cylinder 120 and is prevented from moving forwardly within the passage 125.

Figure 5:
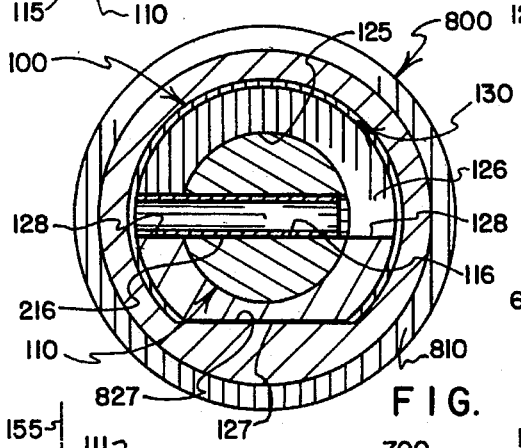

Referring to FIGS. 1, 2 and 5, a slot 126 is formed through the cylinder 120 and extends in a plane that is perpendicular to the center axis 111 (i.e., the plane that is indicated by the line 5—5 in FIG. 2). The slot 126 that is formed in the cylinder 120 aligns with the hole 116 that is formed in the plug 110 so that, when the roll pin 216 is pressed part way into the hole 116 (with one of its end regions left to project outwardly from the hole 116 and into the slot 126), the roll pin 216 cooperates with the cylinder 120 both to provide a secondary means of ensuring that the plug 110 cannot be forcibly removed from the cylinder 120, and to limit the range of angular movement through which the plug 110 can be rotated about the axis 111 relative to the cylinder 120.

While the slot 126 is depicted as being sufficiently lengthy to enable the plug 110 to rotate about the center axis 111 relative to the cylinder 120 through a permitted range of angular movement of about one hundred eighty degrees, the length of the slot 126 can be diminished or extended so that opposite ends of the slot 126 will interact with the roll pin 216 to more severely limit, or to less severely limit, the permitted range of angular movement of the plug 110 relative to the cylinder 120. For example, the permitted range of relative angular movement can be limited to a "quarter turn" by shortening the length of the slot 126.

Referring to FIGS. 2 and 3, another way in which the permitted range of angular movement of the plug 110 relative to the cylinder 120 can be diminished is by utilizing a cam member 528 that is configured to define a pair of stop surfaces 529 (one of which is shown in hidden lines in FIG. 3) that come into abutting engagement with opposed sides 830 of a stop formation 829 (shown in FIG. 2, and shown in hidden lines in FIG. 3). The stop formation 829 extends rearwardly from a rear end wall 828 of a housing 800 that surrounds the assembled plug, cylinder and sleeve unit 100.

By carefully positioning the stop surfaces 529, and by carefully configuring the stop formation 829 to define the stop surfaces 830, the range of angular movement of the plug 110 relative to the cylinder 120 (that is permitted by the interaction of the roll pin 216 with opposite ends of the slot 126) can be restricted as may be desired to configure the lock 100 for use in a particular application. For example, the stop surfaces 529 of the cam member 528 depicted in FIG. 3 cooperate with the housing-carried stop surfaces 830 to limit the permitted range of rotation of the plug 110 relative to the cylinder 120 to about ninety degrees (about a "quarter turn").

If it is not desired to restrict the range of permitted angular movement of the plug 110 relative to the cylinder 120 beyond the limited range of movement that is permitted by the interaction of the roll pin 216 with opposite ends of the slot 126, the member that is designated by the numeral 528 can simply comprise a flat washer that has no radially extending stop surfaces 529—whereby the only function served by the flat washer 528 is to space the pawl 700 rearwardly relative to the housing 800 so that, when the pawl 700 is rotated about the center axis 111, the pawl 700 does not inadvertently come into engagement with the rearwardly extending stop formation 829 of the housing 800. Other features of the housing 800 will be described shortly.

Referring to FIG. 2, two other features of the cylinder 120 remain to be described. One is a flat-bottom groove 127 or "flat" 127 that is defined within the vicinity of the juncture of the bottom side of the cylinder 120 with its rear end wall 124. The flat 127 is engaged by a formation 827 of the housing 800 to prevent rotation of the plug, cylinder and sleeve unit 100 relative to the housing 800—a feature that is best seen in FIGS. 2 and 5, the purpose for which will be described more completely later herein. The other feature is the provision of a small, closed-end hole 129 that is formed in the bottom side of the cylinder 120 at a location that is a short distance forward from the location of the flat 127 —a feature that is best seen in FIG. 2, the purpose of which will be described shortly.

The sleeve 130 is a thin-walled tubular member that has a uniform inner and outer diameter along its full length, except at its forward end where an inwardly turned lip 132 is provided. While the inner diameter of the sleeve 130 is selected to permit the sleeve 130 to be slided onto the cylinder 120 to extend perimetrically about tumbler-carrying portions of the cylinder 120, the inner diameter is selected to provide a very snug fit about the cylinder 120 that will assist in retaining the sleeve 130 in place on the cylinder 120. As is best seen in FIG. 2, the lip 132 is turned inwardly only to a sufficient degree to ensure that it engages front rim portions of the cylinder 120 to prevent unwanted rearward movement of the sleeve 130 relative to the cylinder 120 after the sleeve 130 has been duly installed on the cylinder 120.

To assemble the components that are depicted in FIG. 1, the plug 110 is inserted into the plug-receiving passage 125 of the cylinder 120 so that the spring clip 213 and the roll pin 216 can be installed to prevent unwanted removal of the plug 110 from the cylinder 120. With corresponding sets of the pin-receiving holes 450 & 550, 460 & 560, and 470 & 570 aligned, corresponding sets of the tumbler pins 150 & 250, 160 & 260, and 170 & 270 are installed therein, as are the springs 350, 360, 370, whereafter the sleeve 130 is slided snugly into place in surrounding engagement with tumbler-carrying portions of the assembled plug and cylinder 110, 120. Referring to FIG. 2, a rear end portion 131 of the material of the sleeve 130 is staked into the closed bottom hole 129 provided on the underside of the cylinder 120 to secure the sleeve 130 in place on the cylinder 120.

Referring to FIG. 2, the cylinder and plug assembly 100 typically is installed in a generally cylindrical housing 800 that has an enlarged diameter bezel ring 810 near its front end, that defines a cylinder-receiving passage 820 that extends centrally through the generally cylindrical housing 800, and that defines the rear wall 828. The cylinder-receiving passage 820 is of substantially uniform diameter along its length except in the vicinity of its rear end region, where a sequence of two stepped-down diameters 822, 824 are defined, and where the previously mentioned "flat" 827 is defined as extending forwardly from the region of the stepped down diameter 822 (best seen in FIG. 5). Referring to FIGS. 2 and 5, the flat 827 extends into underlying juxtaposed relationship with the flat 127 that is defined by the cylinder 120. The interfitting relationship of the flats 127, 827 cooperate to prevent the cylinder 120 (and, thus the plug, cylinder and sleeve unit 100) from rotating within the cylinder-receiving passage 820.

Figure 6:
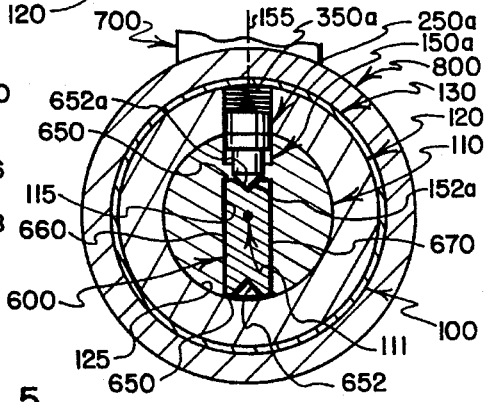
Figure 11:
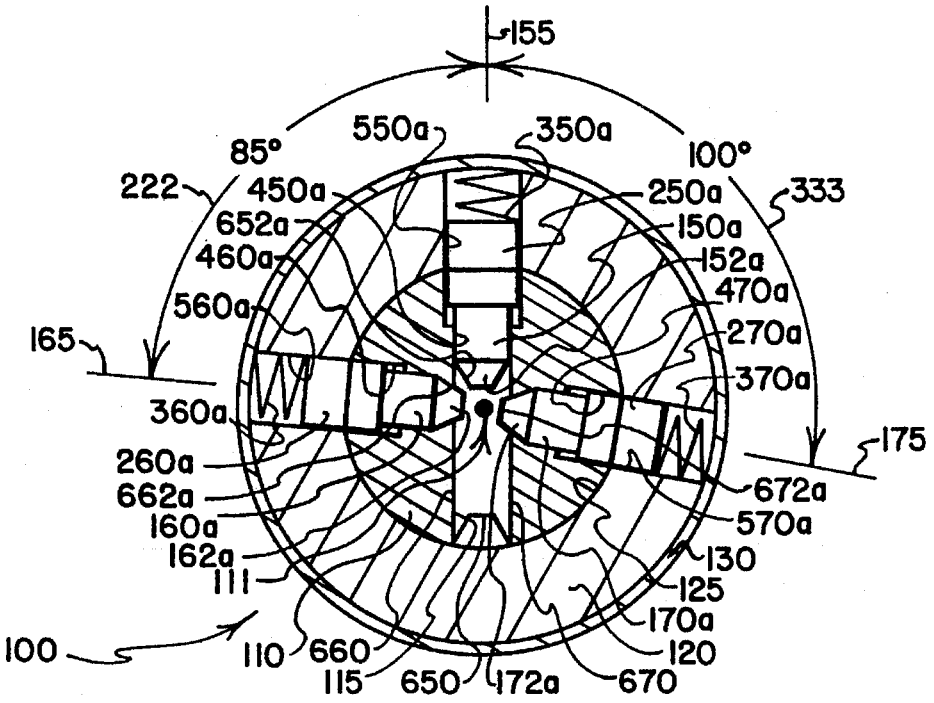
FIG. 11 is a schematic diagram that is provided to aid in explaining what is meant by "angles of inclination" between a first and second row of tumblers, and between a first and third row of tumblers, with the view depicting, substantially in cross-section, selected portions of the plug, cylinder and key, with each of the tumblers that are shown in FIGS. 5, 6 and 7 being depicted as if they were positioned within a common plane; and, FIG. 12 is a schematic diagram depicting two typical sets of inclination angles from which may be chosen the inclination angles that define how the second and third sets of tumblers are to be oriented relative to a first set of tumblers.

Referring to FIGS. 2, 6 and 11, typical bottom and driver pins **150*a*, 250*a* from the first sets of bottom and driver pins 150, 250 are depicted as extending in a first plane 155 that projects vertically upwardly from the center axis 111 of the assembly 100. As will be noted, the first plane 155 substantially parallels opposed flat side surfaces of the key 600 when the key 600 is inserted into the keyway 115. A typical spring 350*a* is shown interposed between the interior surface of the sleeve 130 and the driver pin 250*a* for biasing the pins 150*a*, 250*a* inwardly toward the keyway 115**.

Figure 7:
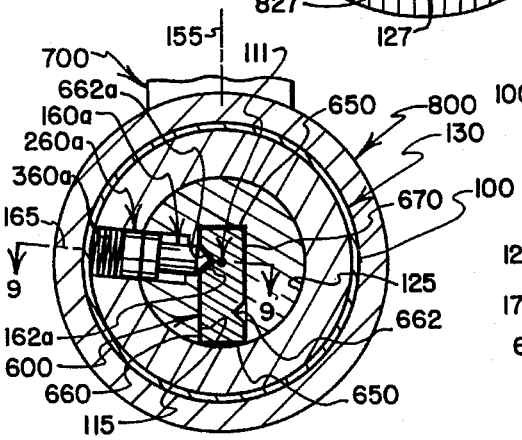
Figure 9:
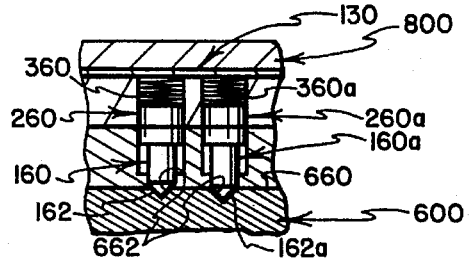
FIG. 9 is a sectional view of selected portions of the assembled lock components, as seen from a plane indicated by a line 9—9 in FIG. 7.

Referring to FIGS. 7, 9 and 11, typical bottom and driver pins **160*a*, 260*a* from the second sets of bottom and driver pins 160, 260 are depicted as extending in a second plane 165 that projects leftwardly and upwardly from the center axis 111 at a first angle of inclination relative to the first plane 155 that is identified by the numeral 222. As depicted in FIGS. 7 and 11, the angle 222 has been selected to equal eighty five degrees. A typical spring 360*a* is shown interposed between the interior surface of the sleeve 130 and the driver pin 260*a* for biasing the pins 160*a*, 260*a* inwardly toward the keyway 115**.

Figure 8:
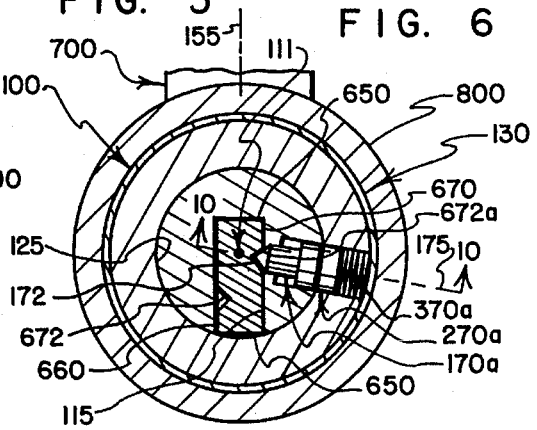
Figure 10:
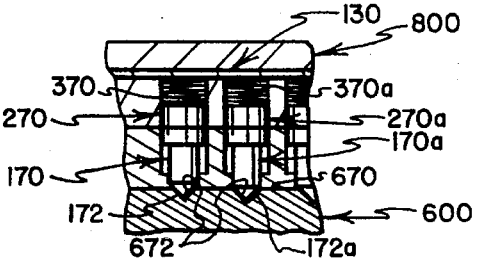
FIG. 10 is a sectional view of selected portions of the assembled lock components, as seen from a plane indicated by a line 10—10 in FIG. 8.

Referring to FIGS. 8, 10 and 11, typical bottom and driver pins **170*a*, 270*a* from the third sets of bottom and driver pins 170, 270 are shown depicted as extending in a third plane 175 that prospects rightwardly and downwardly from the center axis 111 at a second angle of inclination relative to the first plane 155 that is identified by the numeral 333. As depicted in FIGS. 8 and 11, the angle 333 has been selected to equal one hundred degrees. A typical spring 370*a* is shown interposed between the interior surface of the sleeve 130 and the driver pin 270*a* for biasing the pins 170*a*, 270*a* inwardly toward the keyway 115**.

Figure 12:
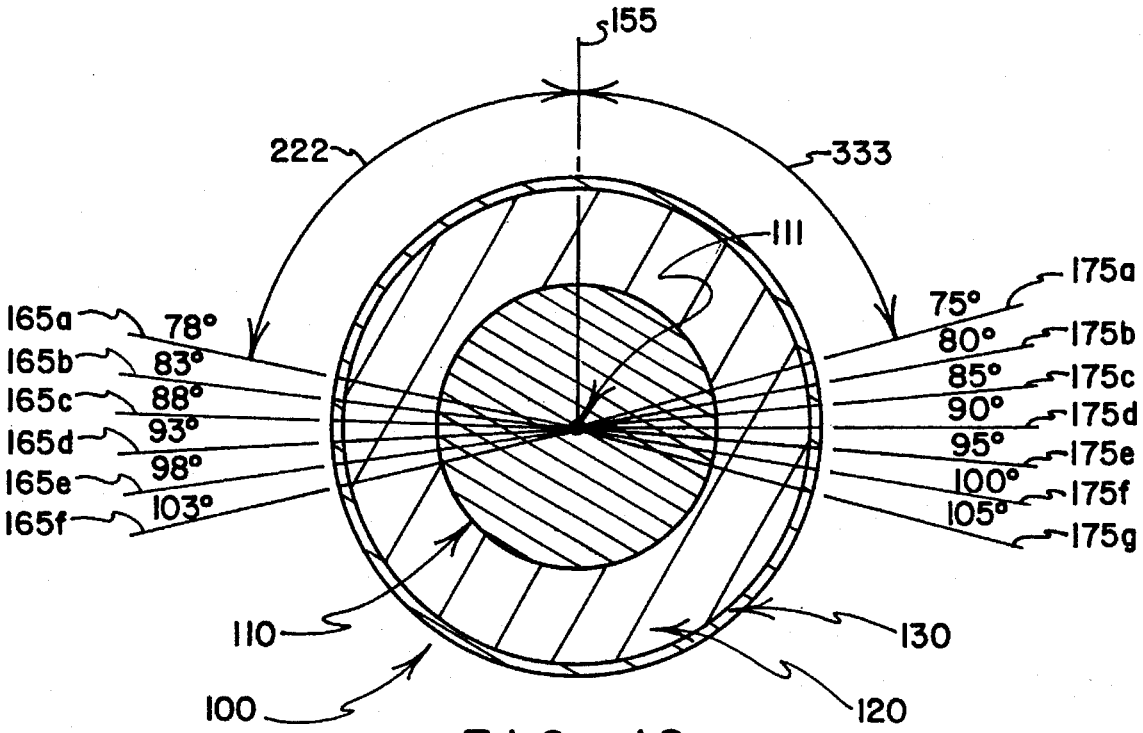

Referring finally to FIG. 12, toward the left side a set of six exemplary angles from which one might elect to select the inclination angle 222 are indicated by planes **165*a*, 165*b*, 165*c*, 165*d*, 165*e* and 165*f*, with these planes being inclined at angles of 78, 83, 88, 93, 98 and 103 degrees, respectively, relative to the plane 155. Toward the right side, a set of seven exemplary angles from which one might elect to select the inclination angle 333 are indicated by planes 175*a*, 175*b*, 175*c*, 175*d*, 175*e*, 175*f* and 175*g*, with these planes being inclined at angles of 75, 80, 85, 90, 95, 100 and 105 degrees, respectively, relative to the plane 155**.

Many other sets of available inclination angles also are possible; however, in selecting such sets (for use with plug and cylinder locks of the invention of the Parent Case, and with keys that form the subject of the present case), all values in each set should reside between about 75 and about 105 degrees, and all values within each set should differ from each other by no less than about five degrees. A set can comprise one selected value (so long as it is between about 75 and about 105 degrees), or from two to seven selected values (so long as the values lie between about 75 and about 105 degrees, and so long as each of the values differs from the other by no less than about five degrees).

Once sets of values have been selected that are to be used for each of the inclination angles 222, 333, some of the values within each of the sets may need to be discarded. For example, no values are to be selected for each of the angles 222, 333 that are substantially equal —for this would result in a substantially symmetrical arrangement of tumbler pins, and a symmetrical arrangement has been found to be easier to pick (and its keys easier to fabricate) than is desired when a high degree of security is to be ensured.

Likewise, no more than one of the inclination angles 222, 333 is to be selected to equal either 90 or 105 degrees, for these are commonly used orientation angles, and selecting more than one of the angles 222, 333 to equal 90 or 105 degrees is found to unduly diminish the degree of security that is afforded. In most preferred practice, the use of 90 and 105 degree values for either of the inclination angles 222, 333 is to be avoided, for any implementation that makes use of these commonly employed angles will not be acceptable in some high security applications.

Likewise, no angles of inclination 222, 333 are to be selected that position the planes 165, 175 so that they substantially align (i.e., so that they extend substantially within a common plane), for aligned plane embodiments also diminish resulting security to an unsatisfactory level.

To illustrate how these guidelines apply, consider an example wherein a decision has been taken to use a 5 degree spacing between possible values within both sets of angle values that can be selected for the angles 222, 333; and wherein the values that comprise each of the sets are to include 75, 80, 85, 90, 95, 100 and 105 degrees. For a first lock and key that are to embody this arrangement, let the angle 105 degrees be selected to comprise the inclination angle 222. For a second lock and key that are to embody this arrangement, let the angle 90 degrees be selected to comprise the inclination angle 222. For a third lock and key that are to embody this arrangement, let the angle 75 degrees be selected to comprise the inclination angle 222. What values then remain open from which the angles 333 can be chosen for each of the first, second and third locks?

For the first lock and key, since the angle 105 degrees was selected to comprise the angle 222, the angle 333 must not also equal 105 degrees, for that would provide both a symmetrical pin arrangement and a "double use" of one of the commonly encountered angles 90 and 105 degrees. The angle value 90 degrees also must be eliminated for use with the angle 333 for the "double use of common values" reason. The only other angle that would need to be eliminated from the remaining values of 75, 80, 85, 95 and 100 degrees is the angle 75 degrees, for use of a 105/75 set of angles will cause the planes 165, 175 to align so as to extend within a common plane.

For the second lock and key, since the angle 90 degrees was selected to comprise the angle 222, the angle 333 must not also equal 90 degrees, for that would provide not only a symmetrical pin arrangement and a "double use" of one of the commonly encountered angles 90 and 105 degrees, but also would result in the planes 165, 175 being aligned so as to extend within a common plane. The angle value 105 degrees also must be eliminated for use with the angle 333 for the "double use of common values" reason. Thus, the values that remain from which a selection can be made for the angle 333 include 75, 80, 85, 95 and 100 degrees.

For the third lock and key, since the angle 75 degrees was selected to comprise the angle 222, the angle 333 must not also equal 105 degrees, for that would cause the planes 165, 175 to align so as to extend within a common plane. The angle value 75 degrees also must be eliminated for use with the angle 333, for a 75/75 set of values for the angles 222, 333 would result in a symmetrical pin arrangement. Thus, the values that remain from which a selection can be made for the angle 333 include 80, 85, 90, 95 and 100 degrees.

A key 600 that is formed in accordance with the guidelines that are presented above will have generally circular-shaped recesses 652 that are formed in the opposed, relatively narrow key edge surfaces 650; and at least one of the sets of recesses 662, 672 that are formed in the opposed flat side surfaces 660, 670 will inherently be of at least slightly non-circular or "oblong" shape. The substantially circular shape of the recesses 652 results from the recesses 652 being milled or drilled by end mills or drills (of conventional configuration, not shown) that are rotated about axes (e.g., the axes 155 of the pin tumblers 152) that extend substantially perpendicular to the plane of the associated edge surface 650. The non-circular shape of at least one set of the recesses 662, 672 results from the recesses 662 or 672 being milled or drilled by end mills or drills (of conventional configuration, not shown) that are rotated about axes (e.g., the axes 165, 175 of the pin tumblers 162, 172, respectively) that do not extend in a perpendicular fashion relative to the opposed side surfaces 660, 670 of the key 600.

If, for example, inclination angles 165*c* and 165*d* of 88 degrees and 93 degrees (see FIG. 12) are utilized to form one or the other of the sets of recesses 662, 672, the resulting shape of the recesses 662, 672 may appear to be substantially circular, but actually will be of non-circular or "oblong" shape—shapes of the small, shallow recesses 662, 672 that are quite difficult to "read" so as to determine the non-standard angles of orientation of the axes 165, 175 about which end mills or drills have been rotated to form the recesses 662, 672—which renders the key 600 difficult to duplicate.

Referring to FIG. 12, if inclination angles 165*b* and 165*e* of 83 degrees and 98 degrees are utilized to form one or the other of the sets of recesses 662, 672, the resulting recesses will have an even greater non-circular or "oblong" shape. Likewise, if inclination angles 165*a* and 165*f* of 78 degrees and 103 degrees are utilized to form one or the other of the sets of recesses 662, 672, the resulting recesses will have an even greater non-circular or "oblong" shape. All of these non-circular or "oblong" shapes that are defined by rotating end mills or drills (of conventional configuration, not shown) about these "non-standard" axis inclination angles 222 and/or 333 are difficult to "read" so as to determine the non-standard axis inclination angles that were used in their formation, hence efforts to duplicate keys of the type that utilize such recesses are rendered difficult.

While such terms as "horizontally extending," "front," "rear," "forwardly facing," "rearwardly facing," "left," "right" and the like are utilized herein, it will be understood that such terms are used merely to aid the reader in referring to features in the orientations in which they are depicted in the accompanying drawings, and are not to be construed as limiting the scope of the claims that follow.

While the invention has been described with a certain degree of particularity, it will be understood that the present disclosure of the preferred embodiment has been made only by way of example, and that numerous changes in the details of construction and the combination and arrangement of elements can be resorted to without departing from the true spirit and scope of the invention as hereinafter claimed. It is intended that the patent shall cover, by suitable expression in the claims, such features of patentable novelty as exist in the invention.

What is claimed is:

1. A difficult-to-duplicate key for operating a lock, wherein the key comprises:

a) an elongate key member that has a pair of opposed, relatively narrow edge surfaces, and a pair of opposed, relatively wide side surfaces that cooperate to provide the key member with a rectangular cross section that is substantially uniform along the length of the key member, and that has an imaginary center axis extending along the length of the key member at a location between the edge surfaces and centered between the side surfaces;

b) first, second and third rows of concave recesses formed in the key member, with the rows each extending lengthwise along the key member;

c) with the recesses of the first row each being symmetrical about and extending along a separate one of a set of first axes that extend parallel to each other and that reside within a common first plane, with the first plane being oriented such that it includes the imaginary center axis and extends from the imaginary center axis to substantially perpendicularly intersect one of the edge surfaces, at which intersection the recesses of the first row are formed in said one edge surface of the key member, with each of the recesses of the first row being substantially circular in shape;

d) with the recesses of the second row each being symmetrical about and extending along a separate one of a set of second axes that extend parallel to each other and that reside within a common second plane, with the second plane being oriented such that it includes the imaginary center axis and extends from the imaginary center axis to intersect one of the side surfaces, at which intersection the recesses of the second row are formed in said one side surface of the key member;

e) with the recesses of the third row each being symmetrical about and extending along a separate one of a set of third axes that extend parallel to each other and that reside within a common third plane, with the third plane being oriented such that it includes the imaginary center axis and extends from the imaginary center axis to intersect the other of the side surfaces, at which intersection the recesses of the third row are formed in said other side surface of the key member;

f) with the second and third planes comprising distinctly separate, non-coplanar planes that intersect with the first plane along the imaginary center axis, and with the second and third planes being inclined relative to the first plane at unequal first and second angles of inclination, respectively, with the first angle being chosen from a first set of angles that reside within a range of about 75 to about 105 degrees, with the second angle being chosen from a second set of angles that reside within a range of about 75 to about 105 degrees, with the angles that comprise the first set differing from each other by no less than about 5 degrees, with the angles that comprise the second set differing from each other by no less than about 5 degrees, and with at least one of the chosen first and second angles of inclination not being equal to either of 90 and 105 degrees; and, g) whereby the recesses of at least one of the second and third rows of recesses are caused to be of non-circular shapes that are difficult to "read" to ascertain the orientation of their associated set of axes, thereby rendering the key difficult to duplicate.

2. The key of claim 1 wherein neither of the first and second angles of inclination is 90 degrees, whereby the recesses of both of the second and third rows are caused to be of non-circular shapes that are difficult to "read" to ascertain the orientations of their associated sets of axes.

3. The key of claim 1 wherein the angles that comprise at least one of the first and second sets include about 75, about 80, about 85, about 90, about 95, about 100 and about 105 degrees.

4. The key of claim 1 wherein the angles that comprise at least one of the first and second sets include about 78, about 83, about 88, about 93, about 98 and about 103 degrees.

5. The key of claim 1 wherein the angles that comprise at least one of the first and second sets include angles that differ from each other by no less than about 10 degrees.

6. The key of claim 5 wherein the angles that comprise said at least one of the first and second sets include about 80, about 90 and about 100 degrees.

7. The key of claim 5 wherein the angles that comprise said at least one of the first and second sets include about 83, about 93 and about 103 degrees.

8. The key of claim 5 wherein the angles that comprise said at least one of the first and second sets include about 75, about 85, about 95 and about 105 degrees.

9. The key of claim 5 wherein the angles that comprise said at least one of the first and second sets include about 78, about 88 and about 98 degrees.

10. The key of claim 1 wherein the angles that comprise the first set of angles include about 75, about 80, about 85, about 90, about 95, about 100 and about 105 degrees, and the angles that comprise the second set of angles include about 75, about 80, about 85, about 90, about 95, about 100 and about 105 degrees.

11. The key of claim 1 wherein the angles that comprise the first set of angles include about 78, about 83, about 88, about 93, about 98 and about 103 degrees, and the angles that comprise the second set of angles include about 75, about 80, about 85, about 90, about 95, about 100 and about 105 degrees.

12. The key of claim 1 wherein the first angle of inclination is selected to be about 75 degrees, and the second angle of inclination is selected from a set of angles that includes about 80, about 85, about 90, about 95, about 100 and about 105 degrees.

13. The key of claim 1 wherein the first angle of inclination is selected to be about 80 degrees, and the second angle of inclination is selected from a set of angles that includes about 75, about 85, about 90, about 95, about 100 and about 105 degrees.

14. The key of claim 1 wherein the first angle of inclination is selected to be about 85 degrees, and the second angle of inclination is selected from a set of angles that includes about 75, about 80, about 90, about 95, about 100 and about 105 degrees.

15. The key of claim 1 wherein the first angle of inclination is selected to be about 90 degrees, and the second angle of inclination is selected from a set of angles that includes about 75, about 80, about 85, about 95, about 100 and about 105 degrees.

16. The key of claim 1 wherein the first angle of inclination is selected to be about 95 degrees, and the second angle of inclination is selected from a set of angles that includes about 75, about 80, about 85, about 90, about 100 and about 105 degrees.

17. The key of claim 1 wherein the first angle of inclination is selected to be about 100 degrees, and the second angle of inclination is selected from a set of angles that includes about 75, about 80, about 85, about 90, about 95 and about 105 degrees.

18. The key of claim 1 wherein the first angle of inclination is selected to be about 105 degrees, and the second angle of inclination is selected from a set of angles that includes about 75, about 80, about 85, about 90, about 95 and about 100 degrees.

19. A method of forming a difficult-to-duplicate key for operating a lock, comprising the steps of:

a) providing an elongate key member that has a pair of opposed, relatively narrow edge surfaces, and a pair of opposed, relatively wide side surfaces that cooperate to define a rectangular cross section that is substantially uniform along the length of the key member, and that has an imaginary center axis extending along the length of the key member at a location between the edge surfaces and centered between the side surfaces;

b) forming first, second and third rows of concave recesses in the key member, with the rows each extending lengthwise along the key member;

c) with the step of forming first, second and third rows of concave recesses including the steps of:

i) forming the recesses of the first row such that each has a shape that is symmetrical about, and extends along a separate one of a set of first axes that extend parallel to each other and that reside within a common first plane, with the first plane being oriented such that it includes the imaginary center axis and extends from the imaginary center axis to substantially perpendicularly intersect one of the edge surfaces, at which intersection the recesses of the first row are formed in said one edge surface of the key member, with each of the recesses of the first row being substantially circular in shape;

ii) forming the recesses of the second row such that each has a shape that is symmetrical about, and extends along a separate one of a set of second axes that extend parallel to each other and that reside within a common second plane, with the second plane being oriented such that it includes the imaginary center axis and extends from the imaginary center axis to intersect one of the side surfaces, at which intersection the recesses of the second row are formed in said one side surface of the key member;

iii) forming the recesses of the third row such that each has a shape that is symmetrical about, and extends along a separate one of a set of third axes that extend parallel to each other and that reside within a common third plane, with the third plane being oriented such that it includes the imaginary center axis and extends from the imaginary center axis to intersect the other of the side surfaces, at which intersection the recesses of the third row are formed in said other side surface of the key member; and, d) with the step of forming first, second and third rows of concave recesses being carried out so as to cause at least one of the second and third rows to be of non-circular shapes that are difficult to "read" to ascertain the orientation of their associated set of axes, thereby rendering the key difficult to duplicate, by orienting the second and third planes such that:

i) the second and third planes comprise distinctly separate, non-coplanar planes that intersect with the first plane along the imaginary center axis; and, ii) the second and third planes are inclined relative to the first plane at unequal first and second angles of inclination, respectively, with the first angle being chosen from a first set of angles that reside within a range of about 75 to about 105 degrees, with the second angle being chosen from a second set of angles that reside within a range of about 75 to about 105 degrees, with the angles that comprise the first set differing from each other by no less than about 5 degrees, with the angles that comprise the second set differing from each other by no less than about 5 degrees, and with at least one of the chosen first and second angles of inclination not being equal to either of 90 and 105 degrees.

20. The method of claim 19 wherein the step of forming first, second and third rows of concave recesses includes the step of selecting the first and second angles of inclination such that neither equals 90 degrees, whereby the recesses of both of the second and third rows are caused to be of non-circular shapes that are difficult to "read" to ascertain the orientations of their associated sets of axes.

21. The method of claim 19 wherein the step of forming first, second and third rows of concave recesses includes the step of selecting the angles that comprise at least one of the first and second sets to include about 75, about 80, about 85, about 90, about 95, about 100 and about 105 degrees.

22. The method of claim 19 wherein the step of forming first, second and third rows of concave recesses includes the step of selecting the angles that comprise at least one of the first and second sets to include about 78, about 83, about 88, about 93, about 98 and about 103 degrees.

23. The method of claim 19 wherein the step of forming first, second and third rows of concave recesses includes the step of selecting the angles that comprise at least one of the first and second sets to include angles that differ from each other by no less than about 10 degrees.

24. The method of claim 23 wherein the step of forming first, second and third rows of concave recesses includes the step of selecting the angles that comprise said at least one of the first and second sets to include about 80, about 90 and about 100 degrees.

25. The method of claim 23 wherein the step of forming first, second and third rows of concave recesses includes the step of selecting the angles that comprise said at least one of the first and second sets to include about 83, about 93 and about 103 degrees.

26. The method of claim 23 wherein the step of forming first, second and third rows of concave recesses includes the step of selecting the angles that comprise said at least one of the first and second sets to include about 75, about 85, about 95 and about 105 degrees.

27. The method of claim 23 wherein the step of forming first, second and third rows of concave recesses includes the step of selecting the angles that comprise said at least one of the first and second sets to include about 78, about 88 and about 98 degrees.

28. The method of claim 19 wherein the step of forming first, second and third rows of concave recesses includes the step of selecting the angles that comprise the first set of angles to include about 75, about 80, about 85, about 90, about 95, about 100 and about 105 degrees, and the step of selecting the angles that comprise the second set of angles to include about 75, about 80, about 85, about 90, about 95, about 100 and about 105 degrees.

29. The method of claim 19 wherein the step of forming first, second and third rows of concave recesses includes the step of selecting the angles that comprise the first set of angles to include about 78, about 83, about 88, about 93, about 98 and about 103 degrees, and the step of selecting the angles that comprise the second set of angles to include about 75, about 80, about 85, about 90, about 95, about 100 and about 105 degrees.

30. The method of claim 19 wherein the step of forming first, second and third rows of concave recesses includes the step of selecting the first angle of inclination to be about 75 degrees, and the step of selecting the second angle of inclination from a set of angles that includes about 80, about 85, about 90, about 95, about 100 and about 105 degrees.

31. The method of claim 19 wherein the step of forming first, second and third rows of concave recesses includes the step of selecting the first angle of inclination to be about 80 degrees, and the step of selecting the second angle of inclination from a set of angles that includes about 75, about 85, about 90, about 95, about 100 and about 105 degrees.

32. The method of claim 19 wherein the step of forming first, second and third rows of concave recesses includes the step of selecting the first angle of inclination to be about 85 degrees, and the step of selecting the second angle of inclination from a set of angles that includes about 75, about 80, about 90, about 95, about 100 and about 105 degrees.

33. The method of claim 19 wherein the step of forming first, second and third rows of concave recesses includes the step of selecting the first angle of inclination to be about 90 degrees, and the step of selecting the second angle of inclination from a set of angles that includes about 75, about 80, about 85, about 95, about 100 and about 105 degrees.

34. The method of claim 19 wherein the step of forming first, second and third rows of concave recesses includes the step of selecting the first angle of inclination to be about 95 degrees, and the step of selecting the second angle of inclination from a set of angles that includes about 75, about 80, about 85, about 90, about 100 and about 105 degrees.

35. The method of claim 19 wherein the step of forming first, second and third rows of concave recesses includes the step of selecting the first angle of inclination to be about 100 degrees, and the step of selecting the second angle of inclination from a set of angles that includes about 75, about 80, about 85, about 90, about 95 and about 105 degrees.

36. The method of claim 19 wherein the step of forming first, second and third rows of concave recesses includes the step of selecting the first angle of inclination to be about 105 degrees, and the step of selecting the second angle of inclination from a set of angles that includes about 75, about 80, about 85, about 90, about 95 and about 100 degrees.

* * * * *